US007407446B2

(12) United States Patent
Bengtson

(10) Patent No.: US 7,407,446 B2
(45) Date of Patent: Aug. 5, 2008

(54) PUTTER WITH ALIGNED FRONT AND BACK WEIGHTS AND A FORWARDLY ANGLED SHAFT

(76) Inventor: Andrew W. Bengtson, 2629 Queen Elaine Dr., Lewisville, TX (US) 75056

( * ) Notice: Subject to any disclaimer, the term of this patent is extended or adjusted under 35 U.S.C. 154(b) by 0 days.

(21) Appl. No.: 11/469,557

(22) Filed: Sep. 1, 2006

(65) Prior Publication Data

US 2008/0058115 A1 Mar. 6, 2008

(51) Int. Cl.
*A63B 53/04* (2006.01)

(52) U.S. Cl. ..... 473/314; 473/340

(58) Field of Classification Search ..... 473/340–341, 473/313–314

See application file for complete search history.

(56) References Cited

U.S. PATENT DOCUMENTS

| | | | | |
|---|---|---|---|---|
| 3,758,115 | A | 9/1973 | Hoglund | |
| 3,873,094 | A | 3/1975 | Sebo et al. | |
| 4,163,554 | A | 8/1979 | Bernhardt | |
| 4,324,404 | A | 4/1982 | Dian | |
| 4,390,184 | A | 6/1983 | Rudell | |
| 4,411,430 | A | 10/1983 | Dian | |
| 4,508,342 | A | 4/1985 | Drake | |
| 5,082,277 | A | 1/1992 | Gingold | |
| 5,544,879 | A * | 8/1996 | Collins | 473/314 |
| 5,662,532 | A * | 9/1997 | Mizumura | 473/314 |
| 5,785,608 | A | 7/1998 | Collins | |
| 5,827,130 | A | 10/1998 | Jimenez et al. | |
| 5,890,969 | A | 4/1999 | Bechler | |
| 6,033,319 | A | 3/2000 | Farrar | |
| 6,203,446 | B1 | 3/2001 | Collins | |
| 6,267,689 | B1 * | 7/2001 | Ambrose | 473/251 |
| 6,409,613 | B1 | 6/2002 | Sato | |
| 6,435,976 | B1 | 8/2002 | Galliers | |
| 6,579,193 | B1 | 6/2003 | McDowell | |
| 6,688,990 | B2 | 2/2004 | Sanchez | |
| 7,077,758 | B2 * | 7/2006 | Rohrer | 473/251 |
| 7,175,537 | B2 * | 2/2007 | Pollman | 473/203 |
| 2003/0045373 | A1 | 3/2003 | Field | |

FOREIGN PATENT DOCUMENTS

JP 10-234888 * 9/1998

* cited by examiner

*Primary Examiner*—Stephen L. Blau
(74) *Attorney, Agent, or Firm*—Husch Blackwell Sanders LLP

(57) ABSTRACT

A putter constructed for an improved golf swing with the desired straight back-and-forth stroke. The putter has a bi-weighted club head with a front face and a butt end. A first weight is positioned behind the front face and a second weight is positioned near the butt end of the club head spaced behind the first weight. The putter has a shaft attached to the club head well behind the front face at the location of the second weight. The shaft is angled toward the front face, so that the golfer's hands are positioned over the front face of the club when lining up a putt. The putter has a modified grip that is shaped to fit the golfer's palm, has a flat surface for placing the thumb, and a flat finger pad for receiving the fingertips.

1 Claim, 4 Drawing Sheets

PUTTER WITH ALIGNED FRONT AND BACK WEIGHTS AND A FORWARDLY ANGLED SHAFT

CROSS-REFERENCE TO RELATED APPLICATIONS

None.

FIELD OF THE INVENTION

This invention relates to golf clubs and more particularly to golf putters.

BACKGROUND OF THE INVENTION

For most golfers, a proper putting stroke is a difficult endeavor. Balancing the direction and force of the swing to smoothly roll the ball into the cup is sometimes overwhelming. Golf club designers have tried for many years to harness technology to make the game easier. Many improvements in clubs have helped to add distance to a drive or straighten out a poor shot. A common problem, particularly for new golfers, is the unnatural feel of a putting swing. A good putting swing begins with a proper stance and grip position. A forward press is a recommended grip position, where the hands are slightly angled toward the ball from bottom to top. This is not an intuitive grip position, so amateur golfers often have difficulty adopting this recommendation.

It is known in the art to angle the shaft to provide for a better swing. U.S. Pat. No. 4,163,554 to Bernhardt teaches a shaft slanting away from the front face of the club, as shown in FIGS. 1 and 2. U.S. Pat. No. 5,785,608 to Collins discloses a shaft slanted toward the front face and the golfer. Likewise, U.S. Pat. No. 5,890,969 to Bechler teaches an angled shaft.

Further, a successful putting stroke needs a straight back-and-forth motion in the nature of a pendulum motion. Unfortunately, this motion is difficult to perform consistently. Some clubs have been modified to provide for a larger sweet spot or strike zone. Generally, these putters have placed weights in the heel and toe of the putter on opposite sides of the strike zone to keep the putter face stable at impact. The sweet spot is the area on the club face where the club should contact the golf ball during the swing for an optimal shot. Unfortunately, a heel-to-toe weighted putter does not improve the stroke and can only correct for a poor swing to a limited extent if the club is off-center or if the putter face is angled.

Other clubs have used a multiple-weight system to enhance the sweet spot. These clubs generally position weights at the face of the club on either side of the sweet spot and at the rear of the club head. Specifically, U.S. Pat. No. 5,544,879 to Collins teaches a weighted club head with two weights positioned substantially in front of the shaft. These weights are elongated through the width of the club head and run parallel on either side of the center line of the club head. Likewise, U.S. Pat. No. 4,411,430 to Dian features an elongated rod as a weight extending through the width of the club head. Other examples of weight configurations include U.S. Pat. No. 3,758,115 to Hogland and U.S. Pat. No. 6,033,319 to Farrar.

What is needed is a club that automatically places the golfer in a forward press position and encourages the straight back-and-forth pendulum swing desired for a consistently successful putting stroke.

BRIEF SUMMARY OF INVENTION

In response to the problems faced by golfers in adopting the proper grip and putting stroke, the putter of the present invention was created. The putter includes a bi-weighted club head with the weights preferably aligned perpendicular to the plane of the club face. One of the weights may be positioned behind the sweet spot or strike zone and the other weight may be placed approximately 3 inches behind the first weight. In this configuration, the weights are not both positioned at the club face, as in many previous golf putters. The front-to-back configuration encourages the desired front-to-back swing, straight at the golf ball. The weights are preferably substantially equal in size and weight. The area of the club head between the two weights may but need not be substantially open, with two thin connecting bars holding the weights together.

The shaft of the putter is attached to the club head at the rear or butt end of the club head, as opposed to elsewhere on the club head. The shaft is angled toward the front of the club head from bottom to top to position the grip of the shaft above the face of the club head. The angled shaft places the golfer's hands in the desired forward press position when addressing the ball. The hands are angled toward the ball from bottom to top just as the shaft is angled.

The grip is shaped to fit comfortably in a golfer's hand. The grip is constructed to position the thumb properly along the grip to align the hands, wrist, and forearm in the proper position. The golfer's swing will be steadier and feel more natural with the hands positioned around the improved grip. The grip has a substantially flat surface for thumb placement and is curved around its rear surface for a right-handed club to fit better in the right palm. The front side of the grip may be generally flat to accommodate the fingertips.

DETAILED DESCRIPTION OF THE PREFERRED EMBODIMENT

Figure 1:
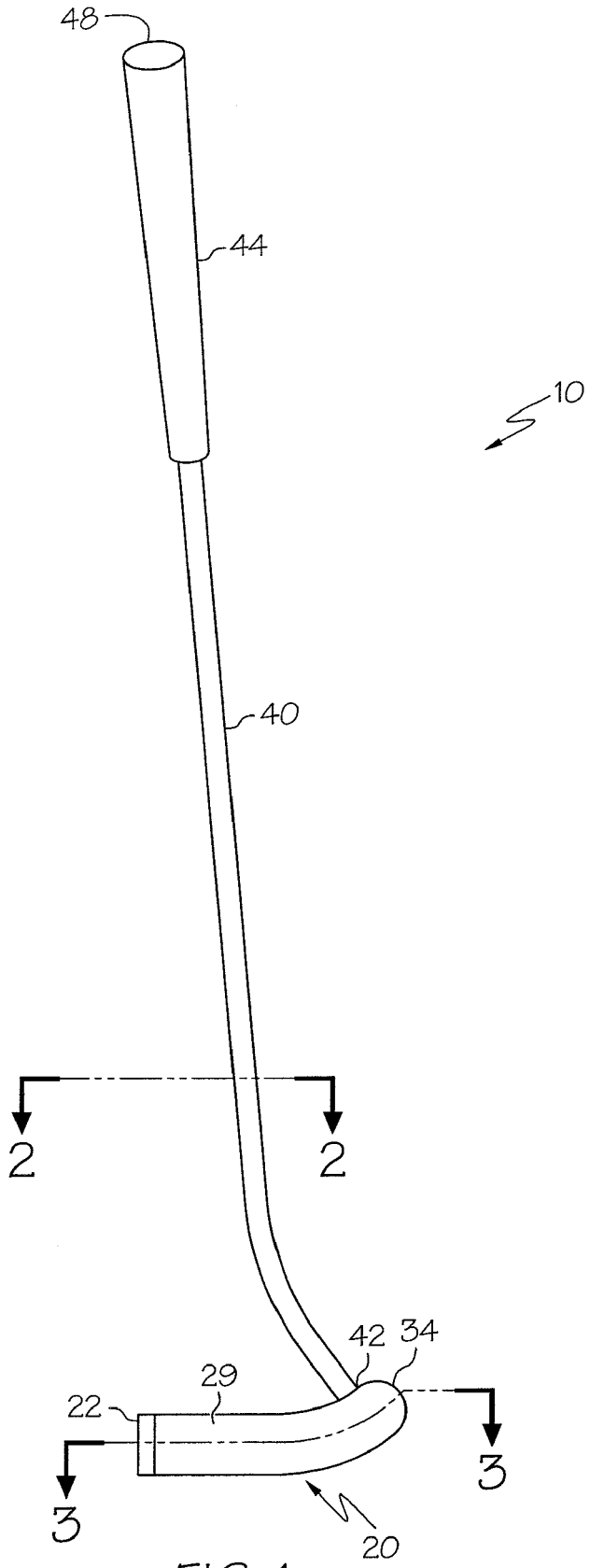
FIG. 1 is an elevational side view of a putter constructed according to a preferred embodiment of the present invention.
Figure 2:
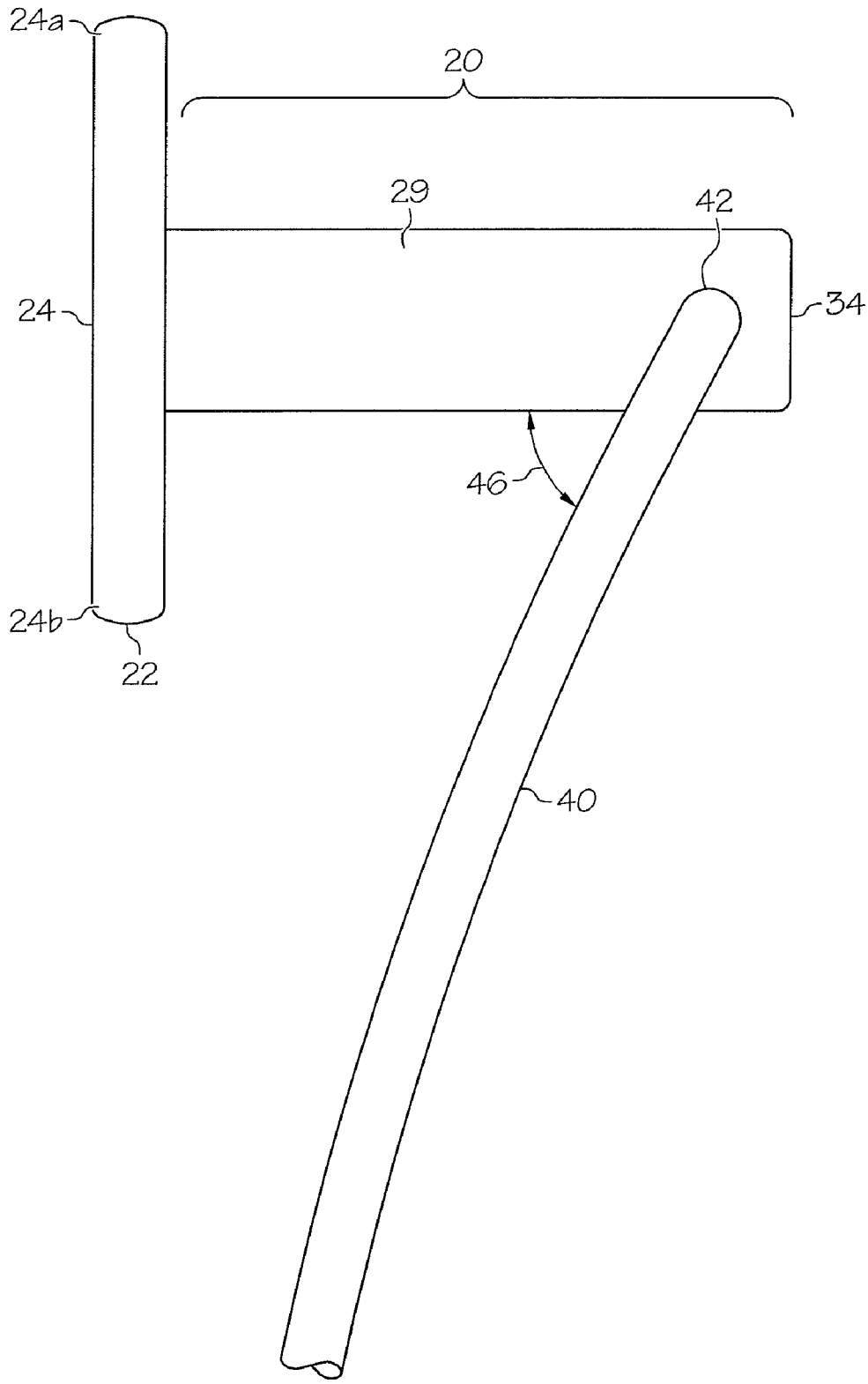
FIG. 2 is an enlarged plan view taken generally along line 2-2 of FIG. 1 in the direction of the arrows.
Figure 3:
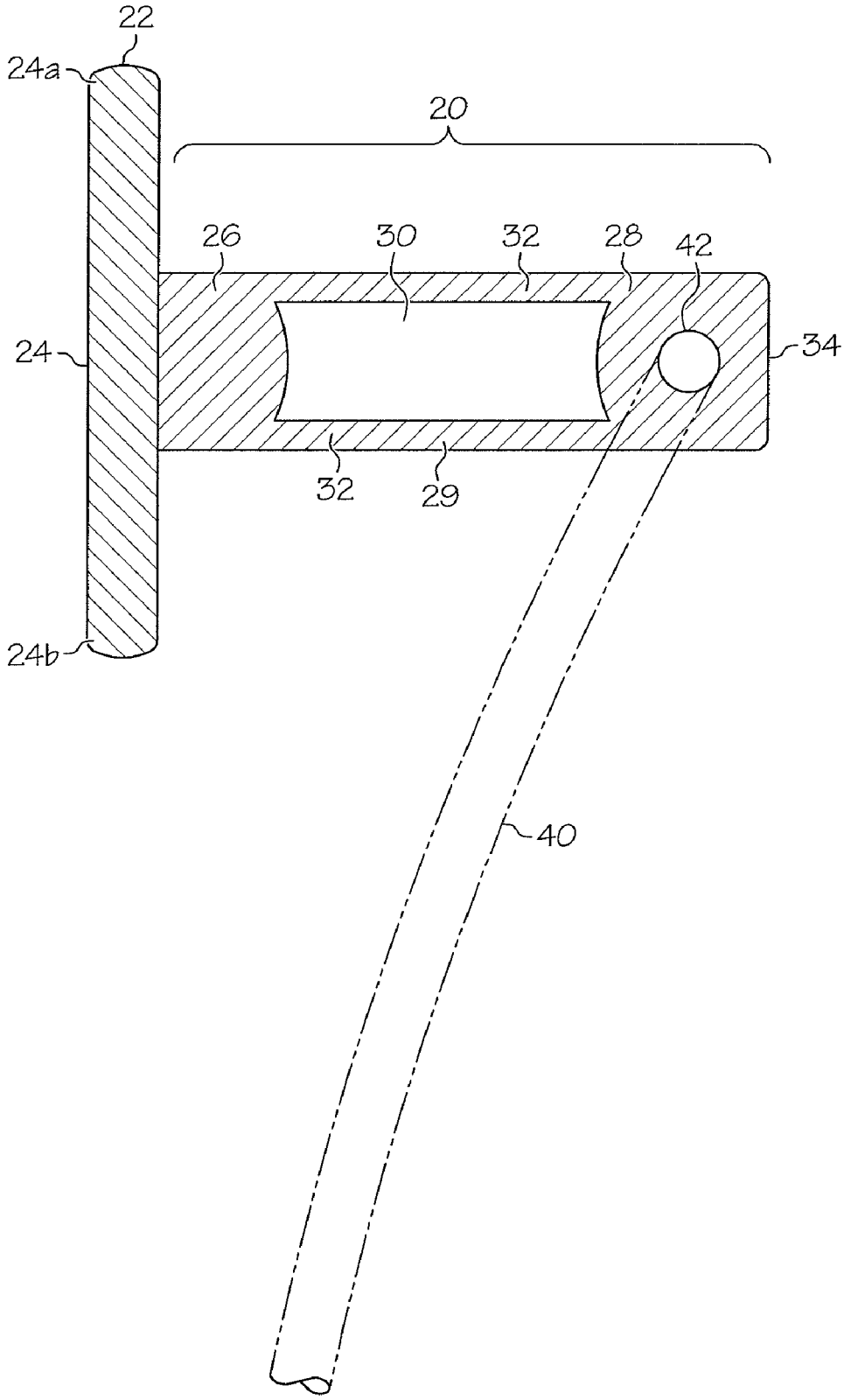
FIG. 3 is a sectional view taken generally along line 3-3 of FIG. 1 in the direction of the arrows, with a portion of the shaft shown in broken lines.

A putter 10 constructed according to a preferred embodiment of the present invention is shown in FIG. 1. The putter 10 generally includes a club head 20 and a shaft 40. The club head 20 has a front face 22 and a butt end 34. As shown in FIG. 3, the club head further includes an impact weight 26 and a rear weight 28, which may be formed on a body 29 connected with the face 22. The shaft 40 includes a grip 44 (FIG. 1) and is connected with the head 20 at an attachment point 42.

Referring in greater detail to the club head 20, it may be constructed from materials with different densities or of the same material. The materials may include metals, plastics or other composite materials that provide the desired overall weight to the club and other suitable characteristics. The front face 22 may be constructed of the same or a different material than the remainder of the club head 20. The front face 22 provides a substantially rectangular surface positioned at the front of the club head 20 for impacting a golf ball. The front face 22 includes a sweet spot or strike zone 24 (FIG. 3) located at the center of the front face. The strike zone 24 is the preferred contact point for hitting the golf ball, although any portion of the front face may contact the ball. The front face 22 may be smooth or textured. The front face may include a marking (not shown) to indicate the strike zone 24 to the golfer. In an alternative embodiment, the front face may be angled forward or backwards relative to the golf ball. A toe area 24*a* is at one end portion of the face 22 and a heel area 24*b* is at the opposite end portion.

As best shown in FIG. 3, the impact weight 26 is positioned immediately behind and is attached to the front face 22, and in a most preferred embodiment, the impact weight is positioned directly behind the strike zone 24. The rear weight 28 is similar and preferably identical in size and weight to the impact weight 26. The rear weight 28 is located behind the impact weight near the butt end 34. In a preferred embodiment, the impact weight and the rear weight are centered on a line perpendicular to the plane of the front face 22 and centered on the length dimension of the front face. The weights 26 and 28 may be formed on a single unitary body 29 that does not occupy the entire length of the club face 22 between the toe and heel areas 24*a* and 24*b*. The length of the face 22 may be approximately three times the width of the body 29.

As shown in FIG. 3, the weights 26 and 28 are spaced apart in front of and behind an open area or void 30. The void separates the impact weight 26 and rear weight 28. If void 30 is present, the two weights may be connected by two thin strips 32. The area between the weights 26 and 28 has much less weight than either of the weights 26 and 28. The strips 32 (if present) extend parallel to one another on opposite sides of the void 30. The connector strips 32 may be constructed from any material sturdy enough to withstand the normal wear-and-tear of golf and may be integral with the weights 26 and 28 or separate members suitably attached to the weights.

The butt end 34 of the club head is adjacent to the rear weight 28 and near the attachment point 42 for the shaft 40. The butt end 34 is elevated relative to the front face 22 and curves upwardly as it extends rearwardly (see FIG. 1).

The shaft 40 may be made of graphite, steel, or any other material suitable for a golf club shaft. The attachment point 42 for the shaft is behind the majority of the weight of the club head. In a preferred embodiment, the attachment point 42 is approximately 3 inches behind the front face 22 on top of the club head at or near the butt end 34 and in line with the strike zone 24 (i.e., in a vertical plane passing through the strike zone and perpendicular to the face 22). The shaft is angled forwardly as it extends upwardly to terminate with the grip 44 and the top 48 of shaft 40 substantially aligned with the front face 22. When the hands are applied to the grip 44, they will be in the forward press position because of the angle of the shaft, and the golfer's hands will be directly above the ball. By attaching the shaft 40 at point 42 behind the majority of the weight in the club head and elevating the butt end 34, the club will naturally swing like a pendulum and encourage the consistent straight back-and-forth motion that will result in the optimum contact with the ball. As opposed to other club heads that place the weight on either side of the sweet spot or strike zone (such as at or near the club face toe and heel areas 24*a* and 24*b*), the two weights are placed behind the strike zone, separate from one another with the rear weight 28 elevated to keep the swing straight. The two weighted areas tend to follow one another, so the swing path, which is coaxial with the center line of the weights, is centered on the sweet spot.

Figure 4:
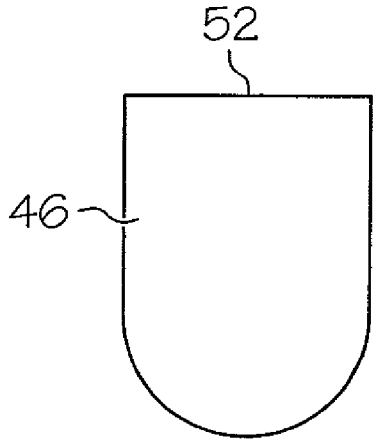
FIG. 4 (PRIOR ART)
FIG. 4 is a top plan view of a cornerstone grip for a putter.
Figure 5:
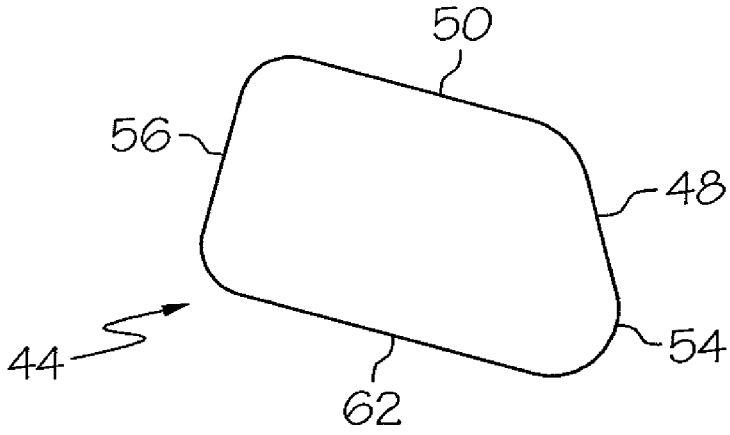
FIG. 5 is a top plan view of a grip constructed according to a preferred embodiment of the present invention.

As shown in FIG. 5, the grip 44 is improved to provide better positioning of the hands when addressing the ball. The traditional grip, shown in FIG. 4, is generally flat on one side 52 and oval or rounded on the remaining sides. The flat side 52 is generally perpendicular to the club face. The flat side is traditionally where the thumb is placed. The palm and fingers then curl around the oval portion of the grip. The oval portion is an awkward fit for the palm and fingers, as they do not form a uniform or symmetrical oval when curled around the grip.

The improved grip 44 (FIG. 5), for a right-handed club, has a substantially flat thumb pad 50 and includes a curved surface 54 for the palm. The grip 44 has a flat or slightly rounded surface 62 for the fingers from the palm to outer knuckle joints and another generally flat surface 56 for receiving the tips of the fingers beyond the outer knuckle joints. This configuration may be reversed for a left-handed club. This shape of the grip, as seen in FIG. 5, may extend through the length of the grip 44.

The flat thumb pad surface 50 preferably occupies a plane that is angled in a direction rotated clockwise (when viewed from above) relative to a plane perpendicular to the front putter face 22. The angle of surface 50 from a plane perpendicular to face 22 should not exceed 30°. The curved surface 54 receives the palm and base areas of the fingers and intersects with surface 50. Another surface 62 may be of any desired shape and is preferably flat or nearly flat. The flat finger pad surface 56 intersects with surfaces 50 and 62 to provide a comfortable fingertip rest.

The thumb pad 50 is in a plane that is angled from a plane perpendicular to the putter face such that the hands are rotated slightly in a clockwise direction (viewed from above) from a traditional hand position for putting, thus providing a more desirable position for addressing the ball. Likewise, the curved surface 54 is a more comfortable fit for the palm, and the flat surface 56 for the fingertips provides additional comfort. This improved grip is more comfortable and less awkward than the traditional grip, allowing the golfer to relax more and think less about the grip when addressing the ball. This improved grip also keeps the hand, wrist and arm working together as a unit, which creates a better swing.

The improved putter of this invention thus provides for an improved swing by aligning two weights in the club head with the rear weight elevated to create a natural pendulum motion that encourages a straight back-and-forth swing. The weights tend to follow one another along a path extending through the sweet spot at the center of the club face so that the sweet spot moves through the ball along a straight and consistent path that is perpendicular to the club face. The angled shaft attached to the club head at the rear of the club head positions a golfer in the desired forward press position when addressing the ball and promotes a straight takeaway to begin the stroke. Finally, the grip offers a more comfortable and effective hand placement. These combined features provide a putter that naturally places even amateur golfers in the correct position and grip and enhances their putting stroke.

Although embodiments of the invention have been shown and described, it is to be understood that various modifications, substitutions, and rearrangements of parts, components, and materials can be made by those skilled in the art without departing from the novel spirit and scope of the invention.

The invention claimed is:

1. An improved golf putter, including:

a bi-weighted club head comprising a front face with a strike zone, a first weight adjacent to and behind the front face, and a second weight spaced behind the first weight and connected thereto by a connector, said first and second weights being substantially equal in weight and being centered on and occupying a common generally vertical plane passing through said strike zone and said second weight being elevated relative to said first weight and relative to the front face when said head is in the address position with a bottom of the first weight flat from the front to back and parallel to a horizontal plane; and a shaft connected to the club head at a rear portion of the club head adjacent to said second weight, wherein the shaft is angled from the rear of the club head toward the front face from bottom to top.

* * * * *